US011697954B2

(12) United States Patent
Jones

(10) Patent No.: US 11,697,954 B2
(45) Date of Patent: Jul. 11, 2023

(54) ADJUSTABLE DOOR HINGE SYSTEM

(71) Applicant: Whirlpool Corporation, Benton Harbor, MI (US)

(72) Inventor: Christopher A. Jones, St. Joseph, MI (US)

(73) Assignee: Whirpool Corporation, Benton Harbor, MI (US)

( * ) Notice: Subject to any disclaimer, the term of this patent is extended or adjusted under 35 U.S.C. 154(b) by 145 days.

(21) Appl. No.: 17/194,275

(22) Filed: Mar. 7, 2021

(65) Prior Publication Data

US 2022/0282538 A1 Sep. 8, 2022

(51) Int. Cl.
*E05D 7/04* (2006.01)
*E05D 3/02* (2006.01)

(52) U.S. Cl.
CPC ..... *E05D 7/04* (2013.01); *E05D 3/02* (2013.01); *E05Y 2600/12* (2013.01); *E05Y 2600/312* (2013.01); *E05Y 2900/30* (2013.01); *E05Y 2900/31* (2013.01); *E05Y 2900/312* (2013.01)

(58) Field of Classification Search
CPC ..... E05D 7/04; E05D 3/02; E05Y 2600/12; E05Y 2600/312; E05Y 2900/30; E05Y 2900/31; E05Y 2900/312
See application file for complete search history.

(56) References Cited

U.S. PATENT DOCUMENTS 1,185,233 A * 5/1916 Minnis ..... E05D 7/04 16/350
2,027,888 A * 1/1936 Solomon ..... E05D 7/04 16/249
2,527,403 A * 10/1950 Davis ..... F16B 12/32 16/249
2,885,722 A 5/1959 Halliday
2,975,013 A * 3/1961 Wallace ..... E05D 3/022 16/354
3,290,109 A * 12/1966 Vanegas ..... E05D 7/04 428/626
3,389,424 A * 6/1968 Fellwock ..... E05D 7/02 16/392
3,675,271 A * 7/1972 Fellwock ..... E05D 7/081 16/265

(Continued)

FOREIGN PATENT DOCUMENTS

CA 2753949 A1 * 4/2012 ..... E05D 5/04
CN 107083887 A * 8/2017 ..... E05D 3/02

(Continued)

*Primary Examiner* — Hanh V Tran
(74) *Attorney, Agent, or Firm* — Harness, Dickey & Pierce PLC

(57) ABSTRACT

A hinge assembly for a door of a household appliance has a first hinge and a second hinge. The first hinge includes a base portion and a door receiving portion. The base portion includes at least one elongated slot to receive a fastener. The elongated slot enables positioning of the door receiving portion. The second hinge includes a mounting block and a door plate. The door plate has a door receiving portion that has at least one elongated slot to enable positioning of the door receiving portion. The door plate is secured via at least one fastener to the mounting block. The mounting block is movable in a direction substantially perpendicular to the door plate for positioning the door.

14 Claims, 3 Drawing Sheets

(56) References Cited

U.S. PATENT DOCUMENTS 4,010,504 A * 3/1977 Griffin ..... E05D 5/02 16/252
4,167,802 A * 9/1979 Rock ..... E05D 5/0276 411/176
4,319,382 A * 3/1982 Zernig ..... E05D 5/0276 16/302
4,407,044 A * 10/1983 Iseki ..... E05D 11/1014 16/237
4,864,691 A * 9/1989 Gidseg ..... E05D 3/04 312/138.1
5,265,954 A * 11/1993 Keil ..... E05D 11/06 312/405
5,419,085 A * 5/1995 Imbur ..... E06B 9/04 D25/48.1
5,471,709 A * 12/1995 Lanzani ..... A47L 15/4261 16/302
5,621,947 A * 4/1997 Fitz ..... E05D 11/1014 16/388
5,666,764 A * 9/1997 Beatty ..... F25D 23/028 312/405
5,788,351 A * 8/1998 Prunty ..... F24C 15/023 16/DIG. 34
5,826,305 A * 10/1998 Domenig ..... E05D 5/08 16/237
5,884,366 A * 3/1999 Jeong ..... E05D 7/081 16/268
5,920,958 A * 7/1999 Domenig ..... E05D 7/0423 16/245
5,992,028 A * 11/1999 Wing ..... E05D 7/081 33/194
6,286,918 B1 * 9/2001 King ..... E05D 7/04 16/382
6,502,282 B1 * 1/2003 King ..... E05D 7/04 16/388
7,331,644 B2 * 2/2008 Lowe ..... A47B 88/463 312/334.4
7,509,708 B1 * 3/2009 Radke ..... E05D 7/081 16/245
8,245,352 B2 * 8/2012 Park ..... F25D 23/028 16/268
8,307,502 B2 11/2012 Bonomie et al.
9,546,509 B2 1/2017 Siekierka et al.
9,874,049 B1 * 1/2018 McGregor ..... E05D 5/065
11,072,956 B2 * 7/2021 Pavnick ..... F25D 23/028
2002/0101143 A1 * 8/2002 Crooks ..... A47B 88/43 312/334.7
2005/0264146 A1 * 12/2005 Fitz ..... A47B 88/43 312/334.5
2007/0176527 A1 * 8/2007 Sabelhaus ..... E05D 7/081 312/405
2008/0127565 A1 * 6/2008 Taylor ..... E05D 7/04 49/394
2008/0168618 A1 * 7/2008 Hottmann ..... E05F 1/1253 16/50
2009/0077767 A1 * 3/2009 Alehin ..... E05D 7/04 16/237
2009/0251039 A1 * 10/2009 Muhlburger ..... F25D 23/028 312/405
2010/0026155 A1 * 2/2010 Yun ..... E05D 7/081 312/405
2010/0033067 A1 * 2/2010 Kim ..... E05D 7/12 16/221
2011/0209495 A1 * 9/2011 Park ..... F25D 23/028 16/382
2011/0234072 A1 * 9/2011 Hightower ..... A47B 88/43 312/334.8
2012/0032572 A1 * 2/2012 Lee ..... F25D 23/028 312/405
2012/0037642 A1 * 2/2012 Sun ..... F25D 23/028 220/592.02
2014/0232250 A1 * 8/2014 Kim ..... F25D 23/028 312/292
2015/0059126 A1 * 3/2015 Dubina ..... E05D 11/06 16/319
2015/0135479 A1 * 5/2015 Salice ..... E05D 5/0276 16/236
2016/0024827 A1 * 1/2016 Lambright ..... E05F 1/123 49/386
2017/0138104 A1 * 5/2017 Kim ..... F25D 23/028
2018/0156531 A1 * 6/2018 Heisswolf ..... E05D 7/0415
2020/0284077 A1 * 9/2020 Börjesson et al. ... B62D 65/024
2021/0247128 A1 * 8/2021 Jeong ..... E05D 7/04

FOREIGN PATENT DOCUMENTS

CN 107269142 A * 10/2017 ..... E05D 11/00
CN 107951451 A 4/2018
CN 111119622 A * 5/2020 ..... E05D 3/02
DE 3243865 A1 5/1984
DE 9214372 U1 3/1994
DE 10106218 C1 * 5/2002 ..... E05D 7/04
EP 0098257 A2 1/1984
EP 3741945 A1 * 11/2020 ..... E05D 11/06
FR 2637008 A * 3/1990 ..... E05D 3/02
GB 2090322 A * 7/1982 ..... E05D 5/046
GB 2105778 A * 3/1983 ..... E05D 7/04
GB 2490343 A * 10/2012 ..... E05D 7/0054
GB 2559624 A * 8/2018 ..... E05D 7/04
JP 3074243 B2 * 8/2000
JP 3074243 U 12/2000
KR 20170058063 A * 5/2017
KR 102147567 B1 * 8/2020
WO WO-0058580 A1 * 10/2000 ..... A47F 3/0434
WO WO-2010085544 A1 * 7/2010 ..... E05D 3/122
WO WO-2017203770 A1 * 11/2017 ..... E05D 3/04
WO WO-2019196409 A1 * 10/2019 ..... E05F 3/20

* cited by examiner

ADJUSTABLE DOOR HINGE SYSTEM

FIELD

The present disclosure relates to household appliances such as washers, dryers, refrigerators or the like and, more particularly, to an adjustable door hinge system.

BACKGROUND

When securing an appliance door to the housing unit, door alignment with the housing unit for panel gap adjustment and fit and finish poses a consistent problem. This is due to component and assembly variation. Accordingly, when a door is applied to the housing unit, there is the possibility that gap or misalignment may occur during the assembly process. Thus, it is desirable to adjust the door to eliminate the gap and provide an aesthetic fit/finish. It would be desirable to be able to adjust the door during the assembly process to compensate for gaps as well as provide an aesthetic appearance.

The present disclosure provides the art with an adjustable hinge assembly that enables the door, during assembly, to be adjusted onto the housing unit. The door is able to move in two degrees of freedom of direction. Thus, the door may move fore and aft as well as side to side to compensate for gaps as well as fit/finish alignment to provide an aesthetic appearance of the appliance.

SUMMARY

According to a first aspect of the present disclosure, a hinge assembly for a door for a household appliance comprises a first hinge and a second hinge. The first hinge includes a base portion and a door receiving portion. The base portion includes at least one elongated slot to receive a fastener. The elongated slot enables positioning of the door receiving portion. The second hinge includes a mounting block and a door plate. The door plate, with a door receiving portion, includes at least one elongated slot to enable positioning of the door receiving portion. The door plate is secured via at least one fastener to the mounting block. The mounting block is movable in a direction substantially perpendicular to the door plate to position the door. The first hinge is positioned with respect to the second hinge so that the elongated slots are positioned with respect to one another to enable a first and second, fore and aft, adjustment direction of the door. The mounting block enables movement in a direction substantially transverse to the first and second movement directions. The transverse movement enables side to side adjustment of the door. The door receiving portions include a bearing to receive a door shaft. The door plate includes a channel running parallel with the at least one slot. The mounting block includes a tongue engaging the channel to enable movement of the door plate with respect to the mounting block.

According to a second embodiment, a household appliance device, such as washer, dryer or refrigerator comprises a frame, panels secured to the frame defining a housing unit and a treatment device is inside the housing unit. The housing unit includes an opening to receive a door and a hinge system is secured with the frame. The frame includes a channel to receive the mounting block. The channel is sized to enable movement of the mounting block in and along the channel. A hinge assembly for a door for a household appliance comprises a first hinge and a second hinge. The first hinge includes a base portion and a door receiving portion. The base portion includes at least elongated slot to receive a fastener. The elongated slot enables positioning of the door receiving portion. The second hinge includes a mounting block and a door plate. The door plate, with a door receiving portion, includes at least one elongated slot to enable positioning of the door receiving portion. The door plate is secured via at least one fastener to the mounting block. The mounting block is movable in a direction substantially perpendicular to the door plate to position the door. The first hinge is positioned with respect to the second hinge so that the elongated slots are positioned with respect to one another to enable a first and second, fore and aft, adjustment direction of the door. The mounting block enables movement in a direction substantially transverse to the first and second movement directions. The transverse movement enables side to side adjustment of the door. The door receiving portions include a bearing to receive a door shaft. The door plate includes a channel running parallel with the at least one slot. The mounting block includes a tongue engaging the channel to enable movement of the door plate with respect to the mounting block.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
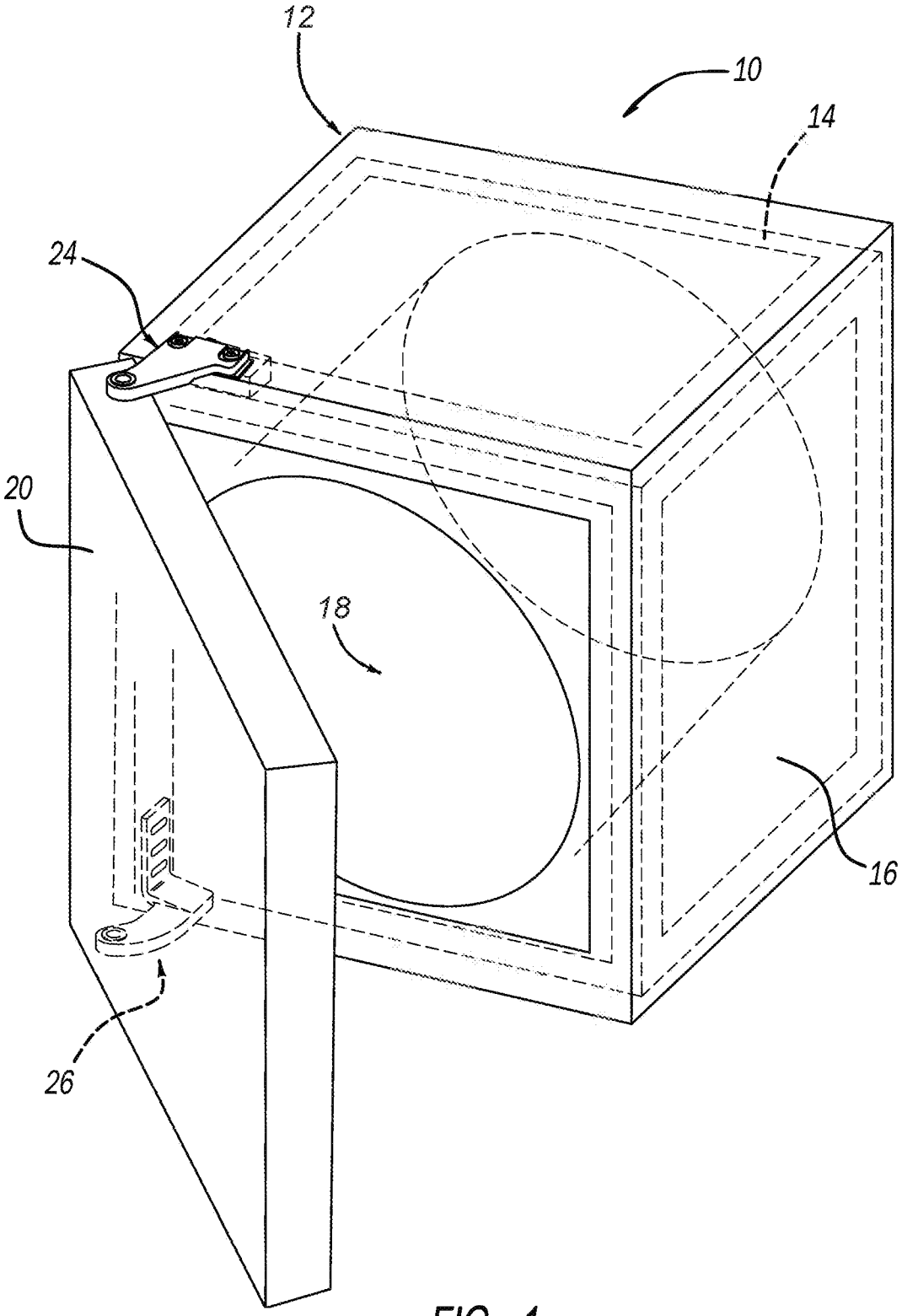
FIG. 1 is a perspective view of a household appliance with the door opened.
Figure 2:
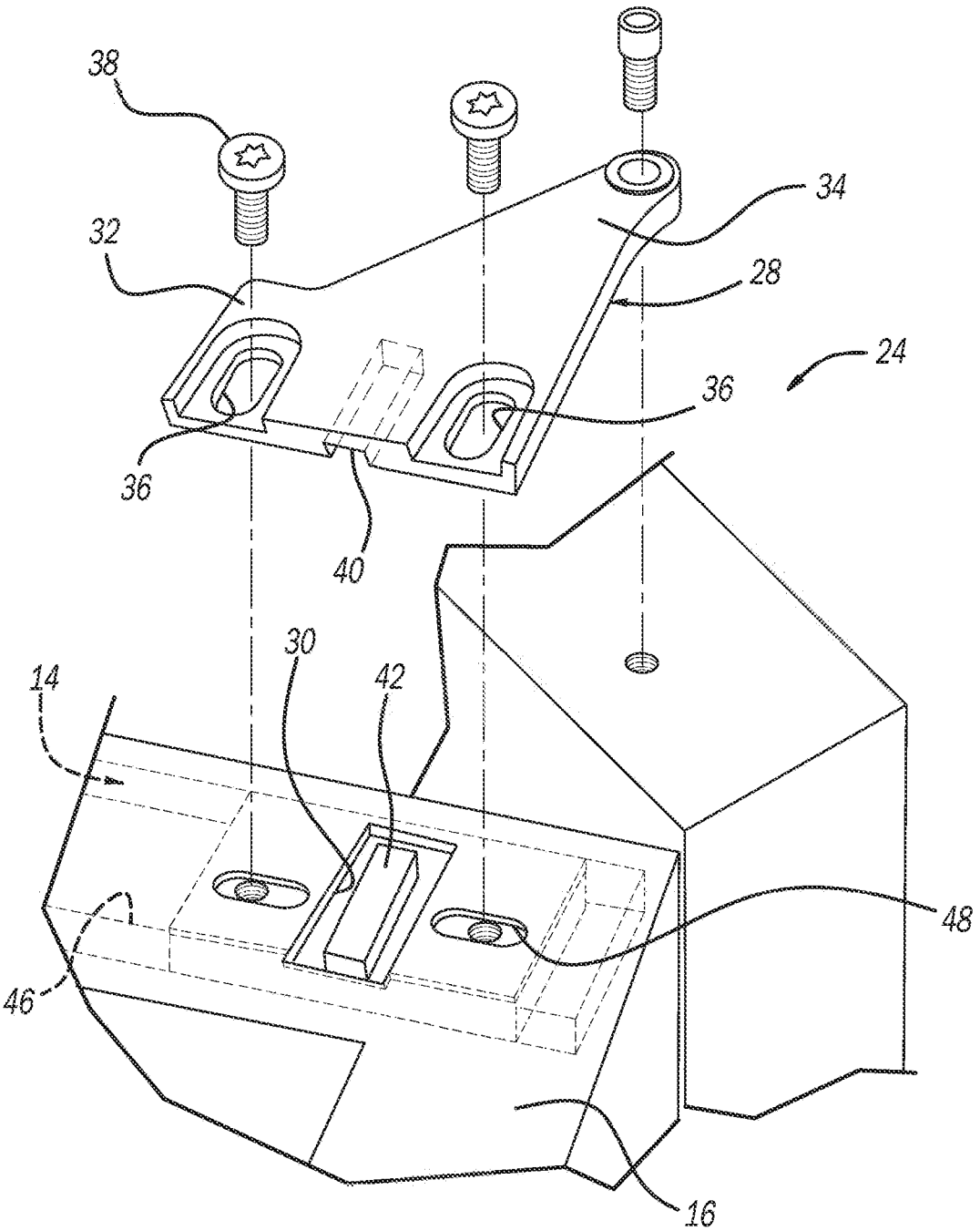
FIG. 2 is an exploded view of FIG. 1.
Figure 3:
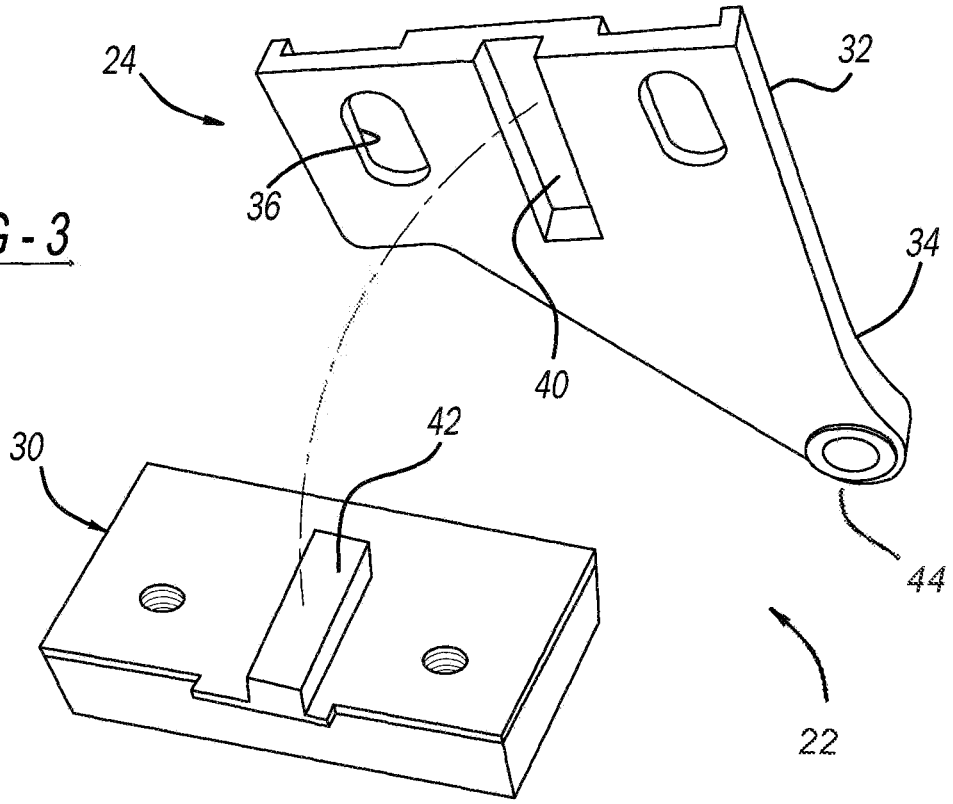
FIG. 3 is an exploded view of the upper hinge.
Figure 4:
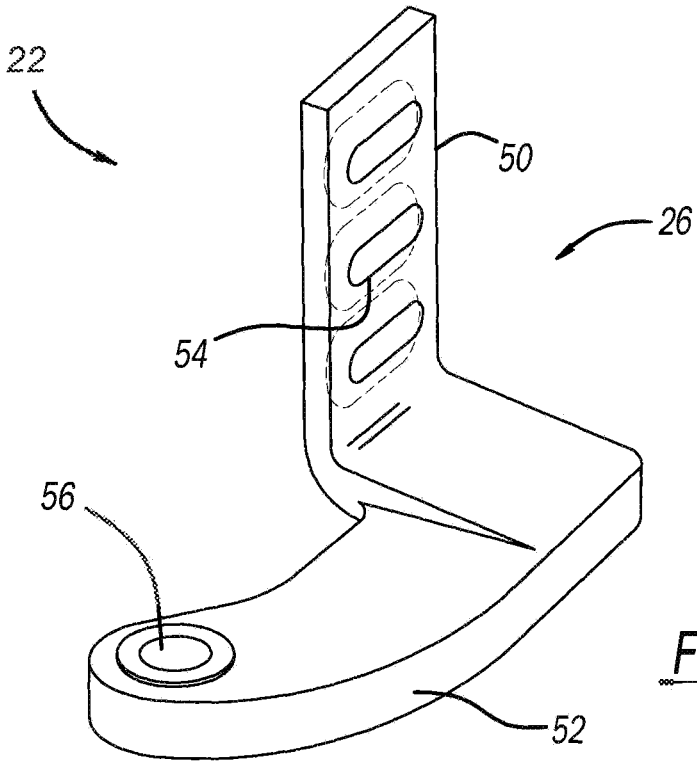
FIG. 4 is an exploded view of the lower hinge.

Example embodiments will now be described more fully with reference to the accompanying drawings.

Turning to the figures, a household appliance, such as a washer, dryer or refrigerator is illustrated and designated with the reference numeral 10. The appliance 10 includes a housing unit 12 that includes a frame 14 that supports the panels 16 forming the housing unit 12. The housing unit 12 includes an opening 18 enabling access into the appliance 10 that includes conventional operating equipment.

The door 20 is secured with the housing unit 12 via a hinge assembly 22. The hinge assembly 22 includes an upper hinge 24 and a lower hinge 26. The upper and lower hinges 24, 26 receive the door 20 to position the door 20 with respect to the housing unit 12.

The upper hinge 24 includes a door plate 28 and a mounting block 30. The door plate 28 has an overall triangular shape with a mounting portion 32 and a door receiving portion 34. The mounting portion 32 includes at least one, two shown in the embodiment, elongated slots 36. The elongated slots 36 enable fasteners 38 to pass through the door plate 28 and secure with the mounting block 30. The mounting portion 32 includes a channel 40 that receives a tongue 42 on the mounting block 30. The channel 40 and tongue 42 act as keyed members to enable the door plate 28 to move or slide with respect to the mounting block 30. Additionally, the tongue 42 and channel 40 provide for smooth reinforced movement between the mounting block 30 and the door plate 28. The channel 40 is parallel with the elongated slots 36 to enable the fore and aft movement of the door plate 28 with respect to the mounting block 30. The door receiving portion 34 includes a bearing 44 that receives a door shaft to enable the door 20 to be positioned on the upper hinge 24.

The mounting block 30 is positioned in a frame channel 46 on the frame 14. The frame channel 46 is sized to enable the mounting block 30 to move along the axis of the frame channel 46 to provide a second degree of movement for the upper hinge 24. Generally, this provides a side-to-side movement of the door 20. The panel 16 also includes slots 48 above the frame channel 46 to enable the fasteners 38 to move while secured with the door plate 28. These slots 48 are substantially perpendicular to the elongated slots 36 of the mounting portion 32.

The lower hinge 26 includes a base portion 50 and a door receiving portion 52. The base portion 50 includes at least one, three are shown, elongated slots 54. The elongated slots 54 enable the base portion 50 to be moved fore and aft on the frame 14. Thus, this enables adjustment of the door 20 with respect to the housing unit 12. The door receiving portion 52 is positioned transversely with respect to the base portion 50. The door receiving portion 52 includes a bearing 56 that receives the door shaft. The lower hinge 26 has an overall L shape with the base portion 50 being a substantial planar portion. The door receiving portion 52 is likewise a planar portion being transverse or perpendicular to the base portion 50. Thus, the base portion 50 may be secured to the frame 14 while the door receiving portion 52 projects from the housing unit 12 enabling the door shaft to be received within the bearing 56.

During assembling, the hinge assembly 22 is positioned onto the frame 14. The fasteners 38 in the slots of the hinges 24, 26 are tightened into the frame 14 and mounting block 30, respectively. They are not fully fastened and enable the door 20 to move with respect to the housing unit 12. The door 20 is positioned onto the housing unit 12 and is manipulated to eliminate any gaps and to provide a desired fit which, in turn, provides a desired finish. Once the door 20 has been manipulated into place, the fasteners 38 are tightened to secure the hinges 24, 26 into position with respect to the housing unit 12. During adjustment, the top or upper hinge 24 may be moved side-to-side by the mounting block 30 moving in the frame channel 46 as well as the door plate 28 being moved fore and aft to accommodate for the fit of the door with respect to the housing unit 12. The lower hinge 26 enables fore and aft movement due to the elongated slots 54 positioned on the base portion 50. Thus, the first or lower hinge 26 is positioned with respect to the second or upper hinge 24 so that the elongated slots 36, 48, 54 are positioned with respect to one another to enable a first and second adjustment direction, fore and aft, of the door 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hinge assembly for a door of an appliance, comprising:

a first hinge and a second hinge;

the first hinge including a base portion and a door receiving portion, the base portion including at least one elongated slot for receiving a fastener; and the second hinge including amounting block and a door plate, the door plate has a door receiving portion and a mounting portion, the mounting portion including at least one elongated slot, wherein the door plate is secured to the mounting block via at least one fastener that is received in the at least one elongated slot in the mounting portion of the door plate, wherein the door plate and the mounting block include a tongue that engages an opposing channel to enable movement of the door plate with respect to the mounting block in fore and aft directions prior to tightening of the fasteners; and wherein the mounting block is movable in a direction substantially perpendicular to the fore and aft directions.

2. The hinge assembly according to claim 1, wherein the first hinge is positioned with respect to the second hinge so that the elongated slots are positioned with respect to one another to enable a first and second adjustment direction of the door.

3. The hinge assembly according to claim 2, wherein the first and second adjustment directions are fore and aft directions.

4. The hinge assembly according to claim 2, wherein the mounting block is moveable relative to the door in a direction substantially transverse to the first and second adjustment directions prior to tightening of the fasteners.

5. The hinge assembly according to claim 4, wherein the transverse movement of the mounting block enables side-to-side adjustment of the door.

6. The hinge assembly according to claim 1, wherein the door receiving portion of each hinge includes a bearing to receive a door shaft.

7. The hinge assembly according to claim 1, wherein the channel is included in the door plate and the channel runs parallel with the at least one elongated slot in the mounting portion of the door plate.

8. The hinge assembly according to claim 7, wherein the tongue is positioned on the mounting block such that the tongue engages the channel in the door plate, enabling movement of the door plate with respect to the mounting block in the fore and aft directions prior to tightening of the fasteners.

9. An appliance comprising:

a frame;

one or more panels secured to the frame to define a housing unit of the appliance;

a treatment device inside the housing unit, the housing unit including an opening for receiving a door and a door hinge system secured with the frame, the door hinge system comprising:

a first hinge and a second hinge;

the first hinge including a base portion and a door receiving portion, the base portion including at least one elongated slot for receiving a fastener; and the second hinge including a mounting block and a door plate, the door plate has a door receiving portion and a mounting portion, the mounting portion including at least one elongated slot, wherein the door plate is secured to the mounting block via at least one fastener that is received in the at least one elongated slot in the mounting portion of the door plate, wherein the frame includes a frame channel that receives the mounting block the frame channel is sized to enable movement of the mounting block along the frame channel prior to tightening of the fastener, wherein the door plate and the mounting block include a tongue that engages an opposing channel to enable movement of the door plate with respect to the mounting block in fore and aft directions prior to tightening of the fasteners; and wherein the mounting block is movable in a direction substantially perpendicular to the fore and aft directions.

10. The appliance according to claim 9, wherein the mounting block is moveable along an axis of the frame channel to provide a second degree of movement for the second hinge prior to tightening of the fasteners.

11. The appliance according to claim 10, wherein at least one of the panels includes slots above the frame channel that are substantially perpendicular to the elongated slots in the mounting portion of the door plate to allow side-to-side movement of the door prior to tightening of the fasteners.

12. The appliance according to claim 9, wherein the door receiving portion of the first hinge is perpendicular to the base portion.

13. The appliance according to claim 9, wherein the appliance is a washer, dryer, or refrigerator.

14. The hinge assembly according to claim 11, wherein the fasteners extend through the elongated slots in the mounting portion of the door plate and the slots in the panel and are tightened into the mounting block.

* * * * *